US006358671B1

(12) United States Patent
Lewis et al.

(10) Patent No.: US 6,358,671 B1
(45) Date of Patent: Mar. 19, 2002

(54) METHODS AND COMPOSITIONS FOR IMAGING AND CLEANING LITHOGRAPHIC PRINTING PLATES

(75) Inventors: Thomas E. Lewis, East Hampstead; Susan J. Lanphear, Nashua, both of NH (US)

(73) Assignee: Presstek, Inc., Hudson, NH (US)

( * ) Notice: Subject to any disclaimer, the term of this patent is extended or adjusted under 35 U.S.C. 154(b) by 711 days.

(21) Appl. No.: 08/715,559

(22) Filed: Sep. 18, 1996

(51) Int. Cl.[7] ..... B41N 1/08

(52) U.S. Cl. ..... 430/302; 430/200; 430/201; 430/331; 101/457

(58) Field of Search ..... 101/457; 430/303, 430/201, 200, 331, 302

(56) References Cited

U.S. PATENT DOCUMENTS

| | | | | | |
|---|---|---|---|---|---|
| 3,933,945 | A | * | 1/1976 | Kondo et al. | 430/303 |
| 4,507,155 | A | | 3/1985 | Cheek | 134/6 |
| 4,690,886 | A | * | 9/1987 | Naritomi et al. | 430/303 |
| 4,842,988 | A | | 6/1989 | Herrmann et al. | 430/14 |
| 5,148,746 | A | | 9/1992 | Fuller et al. | 101/142 |
| 5,378,580 | A | | 1/1995 | Leenders | 430/303 |
| 5,493,971 | A | * | 2/1996 | Lewis et al. | 101/467 |

FOREIGN PATENT DOCUMENTS

| | | | | | |
|---|---|---|---|---|---|
| DE | 19600846 | C1 | | 4/1997 | B41F/35/02 |
| EP | 0 573 092 | A1 | | 11/1993 | |
| EP | 0573091 | A1 | | 12/1993 | B41C/1/055 |
| EP | WO94/01280 | | | 1/1994 | B41C/1/055 |
| EP | 0678380 | A2 | | 10/1995 | B41C/1/10 |
| GB | 1489308 | | * | 10/1977 | |
| WO | WO94/01280 | | | 1/1994 | |

OTHER PUBLICATIONS

Research Disclosure "Method and Material for the Production of a Dry Planographic Printing Plate", Apr. 1980, 19201, p. 131.

* cited by examiner

*Primary Examiner*—Martin Angebranndt
(74) *Attorney, Agent, or Firm*—Testa, Hurwitz & Thibeault, LLP

(57) ABSTRACT

Cleaning compositions for ablation-type lithographic printing plates include solvent, non-solvent and lubricating components, the vapor pressures and concentrations of the various components being chosen such that the mixture never becomes too rich in solvent. In this way, the solvent's effect is directed primarily at thermal byproducts, which, because they are exposed and already partly decomposed, are more vulnerable to solvent action than the intact, anchored plate constituents in unimaged regions. The compositions are used in conjunction with mechanical rubbing of the plate surface following imaging.

20 Claims, No Drawings

METHODS AND COMPOSITIONS FOR IMAGING AND CLEANING LITHOGRAPHIC PRINTING PLATES

BACKGROUND OF THE INVENTION

1. Field of the Invention

The present invention relates to digital printing apparatus and methods, and more particularly to methods and compositions for cleaning lithographic printing members following digital imaging on- or off-press.

2. Description of the Related Art

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-repellent fountain solution prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers. For example, U.S. Pat. Nos. 5,351,617 and 5,385,092 disclose an ablative recording system that uses low-power laser discharges to remove, in an imagewise pattern, one or more layers of a lithographic printing blank, thereby creating a ready-to-ink printing member without the need for photographic development. In accordance with those systems, laser output is guided from the diode to the printing surface and focused onto that surface (or, desirably, onto the layer most susceptible to laser ablation, which will generally lie beneath the surface layer).

U.S. Pat. Nos. 5,339,737 and 5,379,698, the entire disclosures of which are hereby incorporated by reference, disclose a variety of lithographic plate configurations for use with such imaging apparatus. In particular, the '698 patent discloses laser-imageable plates that utilize thin-metal ablation layers which, when exposed to an imaging pulse, are vaporized and/or melted even at relatively low power levels. The remaining unimaged layers are solid and durable, typically of polymeric or thicker metal composition, enabling the plates to withstand the rigors of commercial printing and exhibit adequate useful lifespans.

In one general embodiment, the plate construction includes a first, topmost layer chosen for its affinity for (or repulsion of) ink or an ink-abhesive fluid. Underlying the first layer is a thin metal layer, which ablates in response to imaging (e.g., infrared, or "IR") radiation. A strong, durable substrate underlies the metal layer, and is characterized by an affinity for (or repulsion of) ink or an ink-abhesive fluid opposite to that of the first layer. Ablation of the absorbing second layer by an imaging pulse weakens the topmost layer as well. By disrupting its anchorage to an underlying layer, the topmost layer is rendered easily removable in a post-imaging cleaning step. This, once again, creates an image spot having an affinity for ink or an ink-abhesive fluid differing from that of the unexposed first layer.

A considerable advantage to these types of plates is avoidance of environmental contamination, since the products of ablation are confined within a sandwich structure; laser pulses destroy neither the topmost layer nor the substrate, so debris from the ablated imaging layer is retained therebetween. This is in contrast to various prior-art approaches, where the surface layer is fully burned off by laser etching; see, e.g., U.S. Pat. Nos. 4,054,094 and 4,214,249. In addition to avoiding airborne byproducts, plates based on sandwiched ablation layers can also be imaged at low power, since the ablation layer does not serve as a printing surface and therefore need not be thick to resist abrasion; a durable surface layer is generally thick and/or refractory, ablating only in response to significant energy input.

An accepted approach to cleaning involves subjecting the imaged plate to mechanical action, e.g., rubbing or wiping with a cloth, or the rotation of a brush (see U.S. Pat. No. 5,148,746). Mechanical action can occur under dry conditions or be accompanied by a cleaning fluid. In the latter case, the fluid assists in the cleaning process, reducing the amount and intensity of mechanical friction necessary to remove debris and, as a result, lessening the chance of damage to the intact top layer. The cleaning fluid is generally a non-solvent for that layer, once again in order to avoid damage to unimaged areas. In particular, dry plates utilize silicone top layers, which are permeable to various solvents and tend to "swell" under their influence, resulting in weakened anchorage to underlying layers and, consequently, reduced plate durability and performance. Unfortunately, the need to preserve the silicone layer can limit the overall degree of cleaning effectiveness. Without complete removal of silicone byproducts and other pyrolitic debris from imaged portions of the plate, the necessary affinity difference between ink-repellent and ink-accepting layers cannot be achieved.

In particular, inadequate post-image processing of a silicone-surfaced dry plate results in insufficient retention of ink by the ink-receptive (generally polyester) layer. Yet the source of this behavior is not easily identified; it does not arise merely from stubbornly adherent silicone fragments. Simple mechanical rubbing of the silicone layer, for example, reliably removes from the ink-accepting layer all debris visible even under magnification, and well before damage to the unimaged silicone areas might occur. Nonetheless, such plates still may print with the inferior quality associated with inadequate affinity for ink. And while ink acceptance is substantially improved through cleaning with a solvent, this process can degrade silicone anchorage to unimaged portions of the plate.

DESCRIPTION OF THE INVENTION

Brief Summary of the Invention

Study of the imaging process and its effect on certain types of plate constructions, particularly those containing thin-metal ablation layers below silicone top coatings, suggests that the observed printing deficiencies arise from subtle chemical and morphological changes induced by the imaging process. Plates based on thin-metal imaging layers require heating to substantially higher temperatures to undergo ablation than, for example, laser-imageable printing plates having self-oxidizing (e.g., nitrocellulose) ablation layers. Particularly when low-power imaging sources are used, the exposure time necessary for catastrophic heat buildup can be significant, affording opportunity for unwanted thermal reactions. For example, the low-power imaging pulse of a diode laser must persist for a minimum duration (usually 5–15 $\mu$sec) in order to heat a metal such as titanium beyond its melting point of 1680° C. The resulting thermal breakdown products combine both chemically and mechanically, so that non-solvent cleaning procedures cannot extract all traces of silicone material from the ink-receptive film surface. Moreover, intermixture of these breakdown products interferes with the otherwise natural formation of a textured surface on the film. The combined effect is to reduce the film's oleophilicity.

More specifically, the intense and protracted local heating of the metal layer required to achieve the necessary ablation temperatures exerts a variety of physical effects on the surrounding internal plate structures. Before the metal layer undergoes any change, a bubble forms, lifting the silicone layer. This bubble most likely arises from gaseous, homolytic decomposition of the silicone layer at the interior interface with the rapidly heating metal layer. It has been found that the diameter of the bubble considerably exceeds the beam diameter of the laser pulse.

Subsequently, a hole forms in the metal layer, beginning in the center of the exposed spot and expanding outwardly, as a bead of molten metal, until it reaches the rim of the exposed area. Well after (±100 $\mu$sec) the imaging pulse terminates, the previously lifted silicone settles back. This delay results from the persistence of heat in the silicone and exposed ink-accepting layers due to the relatively low heat-transport rates that characterize polymeric materials. The underlying film also undergoes considerable thermally induced physical changes. The effect of intense heating is typically to impart a porous, three-dimensional texture to the surface of the ink-receptive film exposed by imaging.

Following mechanical cleaning without fluid, however, this textured surface is not observed. Furthermore, the surface energy of the exposed film is much lower than that of the unmodified material. In the case of polyester, for example, surface energies of approximately 25 dynes/cm are observed following dry cleaning, as compared with about 40 dynes/cm in the unmodified material. The observed change in surface energy likely derives from the presence of silicone byproducts mixing with the thermally altered film surface. These byproducts build up over the heat-textured polyester surface, effectively masking that surface. And because the combinations involve chemical as well as mechanical bonds, simple abrasion is insufficient to dislodge the low-surface-energy silicone.

These effects interfere with the resulting plate's acceptance of ink. Low surface energy renders a compound such as silicone abhesive to ink; accordingly, reduction in the surface energy of an oleophilic material will diminish its affinity for ink. In addition, for a relatively viscous offset printing ink to deposit onto a surface from the plate, the ink must overcome internal cohesion forces and split into transferred and retained fractions; this requires developing adhesion to the image area of the plate surface. A three-dimensional textured surface enhances adhesion to the plate, augmenting the interaction provided by a compatible surface energy with mechanical anchorage.

Rubbing the imaged plate with a silicone solvent substantially improves ink acceptance by removing the silicone byproducts through chemical and mechanical action, raising the surface energy of the film to its unmodified state and revealing the three-dimensional texture. Unfortunately, as noted previously, such solvents also act on unimaged silicone, weakening the anchorage to underlying layers and possibly the silicone matrix itself.

The present invention achieves the benefits of solvent-based cleaning without jeopardizing the integrity of unimaged plate regions. In one aspect, the invention comprises a composition having solvent, non-solvent and lubricating components, the vapor pressures and concentrations of the various components being chosen such that the mixture never becomes too rich in solvent. In this way, the solvent's effect is directed primarily at silicone byproducts, which, because they are exposed and already partly decomposed, are more vulnerable to solvent action than the intact, anchored silicone in unimaged plate regions. Preferably, the solvent is capable of solubilizing at least the silicone degradation products; aliphatic solvents are preferred in this regard. However, it is instead possible to utilize solvents effective against only the film degradation products, since the overall result will be removal of the material interfering with ink acceptance; or a solvent effective against both groups of degradation products for maximum debris removal. The non-solvent (which may be an alcohol) provides dilution and additional fluid cleaning action, and the lubricating component (which may be a glycol or a phthalate ester) acts to minimize rubbing damage to the silicone in non-imaged plate regions.

In a second aspect, the invention comprises a method of imaging a lithographic printing member having a layer of an ink-rejecting material and, disposed thereunder, a layer of an ink-receptive material. Due to the physicochemical characteristics of the printing member, its constituent layers and the heat source used to image the printing member, the imaging process results in sufficiently intense heat buildup to cause the accumulation, on the ink-accepting layer, of chemically bound ink-rejecting byproducts. In accordance with the invention, the imaged printing member is rubbed with a liquid composition comprising a major proportion by weight of a non-solvent for the ink-rejecting and ink-receptive material, at least a portion of the non-solvent providing mechanical lubrication, and a minor proportion by weight of a solvent for at least one of the ink-rejecting and ink-receptive material. The result is removal of the unwanted, ink-rejecting debris and exposure of any three-dimensional texture that would otherwise be produced on the ink-accepting layer by the imaging process.

DETAILED DESCRIPTION OF THE PREFERRED EMBODIMENTS

Preferred cleaning compositions include a a major proportion by weight of a non-solvent for the ink-rejecting component of a heat-imageable (and generally laser-imaged) lithographic printing member, at least a portion of the non-solvent providing mechanical lubrication; and a minor proportion by weight of a solvent for the degradation products of at least one of the ink-rejecting and ink-receptive component.

In the case of silicone, the byproducts generated from degradation are primarily polymer fragments, i.e., low-molecular-weight polysiloxanes in linear and cyclic form.

Agents capable of dissolving such material include aliphatic solvents such as heptane or the mostly aliphatic (10% aromatic content) solvent marketed by Exxon Company, USA, Houston, Tex. under the trade name VM&P Naphtha. Although such solvents will not dissolve cured, high-molecular-weight silicone polymers, they can, if used neat or at excessive blend concentrations, swell and thus weaken the silicone layer in unimaged areas, thereby greatly increasing the likelihood of damage to such areas.

Alternatively, worthwhile results can be obtained with solvents that act against byproducts created by degradation of the ink-receptive film. Since the film byproducts tend to be present in substantially greater quantities than the silicone byproducts, removal of the former will typically carry away the latter as well. Dissolution of film degradation products will also more reliably reveal the three-dimensional texture. In the case of polyester materials, degradation byproducts include short-chain polyester polymers and oligomers, terephthalic acid, ethylene glycol and derivatives thereof. Solvents capable of dissolving such materials include methyl ethyl ketone (MEK), acetone and ethyl acetate. Once again, these solvents have little effect on the intact polyester (or silicone) material.

In another alternative, a solvent active against both silicone and film degradation products can be used. Chlorinated solvents such as methylene chloride, trichloroethane and perchloroethane are useful examples of such solvents.

The non-solvent for the silicone and film materials dilutes the solvent concentration and facilitates additional fluid cleaning action. However, excessive concentration of this component (to the exclusion of the solvent) results in the need for an extended cleaning operation which still may not fully remove the problematic degradation products, and which in any case risks mechanical damage to the silicone coating. Preferred non-solvent materials are alcohols such as ethanol, n-propanol, isopropanol and butanol, with isopropanol being preferred due to its widespread use in the printing industry.

The mixture preferably also includes a lubricant non-solvent that provides mechanical lubrication to minimize rubbing damage to the silicone in unimaged areas. Although the cleaning mixture of the present invention allows plates to be finished with a relatively modest amount of rubbing, the presence of a lubricant non-solvent reduces the risk of damage that can occur even inadvertently. Furthermore, this component will tend to exhibit a relatively low vapor pressure, ensuring the persistence of an adequate solvent dilution even if the non-lubricating non-solvent evaporates quickly relative to the solvent. Suitable lubricating non-solvents include glycols, glycol ethers and phthalate esters. Commercial roller/blanket solutions, which include lubricating constituents (such as propylene glycol or phthalate esters) as well as aliphatic solvents can be used directly in combination with the non-solovent alcohol to produce a useful cleaning composition in accordance with the invention.

Cleaning compositions in accordance with the invention preferably contain a non-lubricating non-solvent in a proportion in excess of 50% by weight, a lubricating non-solvent in a proportion ranging from 1–5% by weight, and the solvent in a proportion ranging from 10–49% by weight. In especially preferred embodiments, the non-lubricating non-solvent is present in a proportion ranging from 60–80% by weight, the lubricating non-solvent is present in a proportion ranging from 1–5% by weight, and the solvent is present in a proportion ranging from 15–30% by weight.

The following working examples exemplify practice of the invention.

EXAMPLES

| | EXAMPLES | | | | | | |
|---|---|---|---|---|---|---|---|
| Example | 1 | 2 | 3 | 4 | 5 | 6 | 7 |
| Component | Parts | | | | | | |
| Isopropyl alcohol | 80 | 80 | 80 | 80 | 80 | 80 | 80 |
| WASH V-253 | 20 | — | — | — | — | — | — |
| WASH V-120 | — | 20 | — | — | — | — | — |
| POWER-KLENE VC | — | — | 20 | — | — | — | — |
| POWER-KLENE KF1 | — | — | — | 20 | — | — | — |
| POWER-PRO | — | — | — | — | 20 | — | — |
| PRESS WASH 902X | — | — | — | — | — | 20 | — |
| SUPER INK-O-SAVER | — | — | — | — | — | — | 20 |

In each case, a mixture was prepared by combining 80% (by weight) isopropyl alcohol with 20% (by weight) of one of various blanket washes containing aliphatic solvents and alubricant agent such as a glycol or a phthalate. WASH V-253 and WASH V-120, supplied by Varn Products, Addison, Ill., contain 17% and 18% naphtha, respectively, and approximately 2–3% glycol, phthalate or other similar non-solvent lubricant. POWER-KLENE VC, POWER-KLENE KF1 and SUPER INK-O-SAVER were obtained from Printers'Service, Newark, N.J. The VC product contains 9% $C_9$–$C_{11}$ aliphatics, 9% naphtha and about 2% glycol, phthalate or other similar non-solvent lubricant; the KF1 product contains 9% $C_4$–$C_8$ aliphatics, 10% naphtha and about 1% phthalate or other similar non-solvent lubricant; and the INK-O-SAVER product contains 13% $C_9$–$C_{12}$ aliphatics, about 3% glycol and about 4% phthalate or other similar non-solvent lubricant. The POWER-PRO and PRESS WASH 902X products, which contain aliphatic solvent and lubricant non-solvent components in unknown concentrations, were obtained from POSCO, Inc., Wilmington, Mass.

In each case, imaged plates in accordance with the '698 patent were cleaned by applying the mixture to a 100% cotton cloth and wiping the plate until no further debris appeared on the cloth.

It should be stressed that the approach of the present invention is especially suited to printing plates having metal ablation layers (e.g., the silicone/titanium/polyester plate disclosed in the '698 patent), and which are imaged using a low-power source such as a diode laser. It is less necessary, for example, in connection with constructions that utilize polymeric ablation layers (e.g., carbon-filled nitrocellulose), since such layers undergo ablation at lower temperatures that do not create large quantities of problematic degradation products. Similarly, high-power imaging sources facilitate ablation with commensurately shorter pulses, resulting in more limited heat transport to over- and underlying polymeric layers and, therefore, less thermal damage thereto. In these cases, simple dry rubbing and/or rubbing with a non-solvent is typically sufficient to remove contamination.

It will therefore be seen that the foregoing approach provides a thorough approach to cleaning heat-imaged lithographic printing plates without damage thereto. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member having a layer of an ink-rejecting material and, disposed thereunder, a layer of an ink-receptive material, the method comprising the steps of:

a. imaging the printing member by exposing the member to laser-generated heat in an imagewise pattern to remove or facilitate removal of the ink-rejecting layer, such exposure resulting in deposition of thermal byproducts of the ink-rejecting material onto the ink-receptive layer and generation of thermal byproducts of the ink-receptive material; and b. rubbing the printing member with a liquid composition comprising a major proportion by weight of a non-solvent for the ink-rejecting and ink-receptive materials, at least a portion of the non-solvent providing mechanical lubrication, and a minor proportion by weight of a solvent for byproducts of at least one of the ink-rejecting and ink-receptive materials.

2. The method of claim 1 wherein the printing member comprises an ink-rejecting silicone layer, a laser-ablatable metal layer thereunder, and an ink-receptive polymeric layer beneath metal layer, the exposing step comprising exposure of the printing memeber to laser radiation in an imagewise pattern, thereby deanchoring the silicone layer.

3. The method of claim 2 wherein the metal is titanium and the polymeric layer is polyester.

4. The method of claim 1 wherein the rubbing step removes the deposited ink-rejecting material and texturizes the ink-receptive material.

5. The method of claim 1 wherein the rubbing step does not damage unexposed portions of the ink-receptive layer.

6. The method of claim 1 wherein the solvent dissolves the ink-rejecting material but not the ink-receptive material.

7. The method of claim 1 wherein the solvent dissolves the ink-receptive material but not the ink-rejecting material.

8. The method of claim 1 wherein the non-solvent comprises a major proportion by weight of a non-lubricating non-solvent and a minor proportion by weight of a lubricating non-solvent.

9. The method of claim 8 wherein the non-lubricating non-solvent is an alcohol.

10. The method of claim 9 wherein the alcohol is selected from the group consisting of ethanol, n-propanol, isopropanol and butanol.

11. The method of claim 9 wherein the alcohol is isopropanol.

12. The method of claim 8 wherein the lubricating non-solvent comprises at least one of a glycol, a glycol ether and a phthalate ester.

13. The method of claim 8 wherein the non-lubricating non-solvent is present in a proportion in excess of 50% by weight, the lubricating non-solvent is present in a proportion ranging from 1–5% by weight, and the solvent is present in a proportion ranging from 10–49% by weight.

14. The method of claim 8 wherein the non-lubricating non-solvent is present in a proportion ranging from 60–80% by weight, the lubricating non-solvent is present in a proportion ranging from 1–5% by weight, and the solvent is present in a proportion ranging from 15–30% by weight.

15. The method of claim 1 wherein the lubricating non-solvent evaporates more slowly than both the non-lubricating non-solvent and the solvent.

16. The method of claim 1 wherein the solvent is an aliphatic solvent.

17. The method of claim 16 wherein the aliphatic solvent is heptane.

18. The method of claim 16 wherein the aliphatic solvent is naphtha.

19. The method of claim 1 wherein the solvent is a chlorinated solvent.

20. The method of claim 1 wherein the solvent is selected from the group consisting of methyl ethyl ketone, acetone and ethyl acetate.

* * * * *